US008051978B2

(12) United States Patent
Mori et al.

(10) Patent No.: US 8,051,978 B2
(45) Date of Patent: Nov. 8, 2011

(54) CONTACT LENS STORAGE CONTAINER

(75) Inventors: Osamu Mori, Kasugai (JP); Miya Nomachi, Kasugai (JP); Takeshi Miyawaki, Nagoya (JP)

(73) Assignees: Menicon Co., Ltd., Nagoya-shi (JP); Menicon Nect Co., Ltd., Nagoya-shi (JP)

( * ) Notice: Subject to any disclaimer, the term of this patent is extended or adjusted under 35 U.S.C. 154(b) by 0 days.

(21) Appl. No.: 13/124,622

(22) PCT Filed: Oct. 21, 2008

(86) PCT No.: PCT/JP2008/002982

§ 371 (c)(1),
(2), (4) Date: Apr. 15, 2011

(87) PCT Pub. No.: WO2010/046947

PCT Pub. Date: Apr. 29, 2010

(65) Prior Publication Data

US 2011/0198243 A1 Aug. 18, 2011

(51) Int. Cl.
*A45C 11/04* (2006.01)

(52) U.S. Cl. ..... 206/5.1

(58) Field of Classification Search ..... 206/5, 5.1, 206/524.1, 524.3, 524.6; 134/901
See application file for complete search history.

(56) References Cited

U.S. PATENT DOCUMENTS

| | | | | |
|---|---|---|---|---|
| 5,467,868 | A * | 11/1995 | Abrams et al. | 206/5.1 |
| 2003/0176530 | A1 | 9/2003 | Lindley et al. | |
| 2005/0006255 | A1 | 1/2005 | Peck et al. | |
| 2005/0218012 | A1 * | 10/2005 | Tanaka et al. | 206/5.1 |
| 2008/0105569 | A1 * | 5/2008 | Peck et al. | 206/5.1 |

FOREIGN PATENT DOCUMENTS

| | | |
|---|---|---|
| JP | U-03-035721 | 4/1991 |
| JP | A-2000-281162 | 10/2000 |
| JP | A-2001-070026 | 3/2001 |
| JP | A-2002-006274 | 1/2002 |
| JP | A-2002-526184 | 8/2002 |
| JP | A-2005-511427 | 4/2005 |
| JP | A-2005-160543 | 6/2005 |
| JP | A-2006-511302 | 4/2006 |
| WO | WO 00/16624 A1 | 3/2000 |

OTHER PUBLICATIONS

International Search Report in International Application No. PCT/JP2008/002982; Apr. 7, 2009 (with English-language translation).

* cited by examiner

*Primary Examiner* — Jacob K Ackun
(74) *Attorney, Agent, or Firm* — Oliff & Berridge, PLC

(57) ABSTRACT

Disclosed is a container having a novel structure for storing contact lenses by which biofilm formation can be prevented at a high cost efficiency and from which lenses can be easily taken out. A container for storing contact lenses wherein the inner face of a dish-shaped storage chamber in a case is entirely made of a radius of curvature which is a smooth face with no irregularity and shows a continuous change, the inner face entirely comprises a smooth face with a surface roughness of 60 nm or less, and the solution capacity of the dish-shaped storage chamber is set to 3.8 mL or more.

8 Claims, 6 Drawing Sheets

CONTACT LENS STORAGE CONTAINER

TECHNICAL FIELD

The present invention relates to a contact lens storage container adapted to be used frequently for holding and storing contact lenses in a state immersed in a storage solution. More specifically, the present invention is concerned with a contact lens storage container from which the lenses can be easily taken out, and for which microorganism contamination to the container can be suppressed.

BACKGROUND ART

As one type of contact lens, there has been known multiple use contact lenses that are used repeatedly over several days. For example, this includes soft contact lenses which are not disposable (so-called throwaway), and soft contact lenses which are not thrown away in one day even among the disposable types, and the like. This kind of multiple use contact lenses are stored and kept in a storage container in a state immersed in storage solution when removed from the eyes at bed time, and the like.

Storage containers for holding this kind of multiple use contact lenses are typically constituted including a roughly dish shaped storage portion for storing the contact lenses in an immersed state in which storage solution is accumulated, and a lid member for covering the opening portion of the storage portion (e.g. see Patent Document 1 (JP-A-2000-281162)).

Then, this storage container, over a suitable period, for example every day, is used multiple times with repeated contact lens storage and removal. Because of that, with the storage container, there is a demand by users to be able to easily take out the contact lenses stored within the container.

To deal with that kind of demand, with storage containers of the conventional constitution, the inner surface of the container has a suitably rough surface to prevent sticking of the contact lenses to the inner surface. Also, for the same purpose, there were also items for which a polyhedron shape connected by a curved line extending in the longitudinal direction of the container inner surface was used.

Furthermore, there were many items for which a suitable guide irregularity was added to the inner surface of the container bottom to make it possible to easily pull up the contact lens toward the opening portion from the bottom portion of the storage portion while pressing the contact lens with a fingertip inserted from the opening portion of the storage portion. This guide irregularity is formed, for example, by a plurality of projections respectively extending radially toward the opening portion from the center of the bottom of the storage portion.

Meanwhile, in recent years, there are reports of an increase in eye diseases in contact lens users, and whether those are true or false and what the cause is are being studied.

Here, the inventors of the present invention, as a result of arduous research regarding the causes of disease in contact lens users, focused on the possibility that an improper storage state of multiple use contact lenses like those described above is one cause of these. Specifically, when the inventors of the present invention did testing regarding storage containers with the conventional constitution, we found the generation of biofilms on the inner surface of the storage portion. A biofilm means an aggregation of bacteria agglomerated together in a film state, and when a biofilm forms, the bacteria inside the biofilm are protected from antibacterial agents, so sterilization is difficult. Because of that, when a biofilm is formed in the inner surface of the storage portion, even when the inside of the storage portion is filled with an antibacterial storage solution, the bacteria protected by the biofilm adhere to the lenses, and thus it became clear that there is a risk of causing bacterial infection by this entering the eyeball.

Furthermore, this kind of contact lens storage container is typically sold as a set with storage solution, and when newly purchased when the storage solution runs out, it is assumed that the storage container will also be replaced and the new one used. However, there are many users who do not follow the assumed use method, and this is a cause of biofilms occurring relatively early, and is conjectured to be one factor in the increase in eye diseases in contact lens users in recent years.

In light of this, a number of storage containers have been proposed which have special processes or the like implemented to suppress the formation of biofilms, but all of them are difficult to put into practical use.

In specific terms, for example a contact lens storage container for which a polymer material containing an antimicrobial agent is formed is disclosed in Patent Document 2 (JP-A-2005-511427). However, the polymerization of an antimicrobial agent itself brings on higher costs, and also, there is the problem that further costs are incurred to sufficiently guarantee safety of the antimicrobial agent, so this is poor in terms of practical usability.

Also, in Patent Document 3 (JP-A-2002-526184) and in Patent Document 4 (JP-A-2002-6274) proposed is giving a photocatalytic function to the contact lens storage container. However, these methods also bring on high costs. In fact, the photocatalytic function is an item that exhibits an antibacterial effect under light, so it is in a form for which the storage portion inner surface is covered by a lid portion or the like, and with contact lens storage containers many of which are kept in a dark location such as indoors or inside a bag or the like, not enough light reaches the storage portion inner surface, and because of that it is difficult to exhibit a sufficient antibacterial effect.

Patent Document 1: JP-A-2000-281162
Patent Document 2: JP-A-2005-511427
Patent Document 3: JP-A-2002-526184
Patent Document 4: JP-A-2002-6274

SUMMARY OF THE INVENTION

Problem the Invention Attempts to Solve

The present invention was created with the circumstances described above as the background, and it is accordingly an object of the present invention to provide a contact lens storage container with a novel constitution for which it is possible to suppress the formation of biofilm and to easily take out the lenses with excellent cost efficiency.

Means for Solving the Problem

As a result of arduous, earnest study to resolve the problems described above, the inventors of the present invention discovered that the rough surface and projections formed on the inner surface of the storage portion for making taking lenses out easier from the past have a biofilm form easily. Furthermore, it came to be realized that these rough surfaces and projections are not actually that effective in increasing the ease of taking out lenses.

Specifically, bacteria enters the recesses formed by the rough surface and projections of the storage portion inner surface or the like, making it easy for a biofilm to form. Also, upon taking out the lenses from the storage portions, the lens contact area may decrease with the irregular shape of the rough surface and the projections, in particular, with soft items such as soft contact lenses. However, due to deformation of the lens surface following the irregular shape, it is difficult for the lens to stick to the finger tip, and due to physical friction with the rough surface, we found that in fact there are cases when it is not easy to take out the lens proficiently.

In light of this, the inventors of the present invention achieved the present invention by coming up with a completely different novel idea opposite to the conventional technical awareness.

Following, noted are modes of the present invention made to address the problems described previously. Note that the constitutional elements used with each mode noted hereafter can be used in any combination to the degree possible.

A first mode of the present invention is a contact lens storage container adapted to be used frequently for storing soft contact lenses in a state immersed in storage solution, comprises: a case main unit provided with a dish shaped storage portion that opens upward; and a lid member for covering an opening portion of the dish shaped storage portion, wherein an inner surface of the dish shaped storage portion is smooth with no irregularities along an entire and is formed with a curvature radius that continuously changes, the dish shaped storage portion is a smooth surface with a surface roughness along the entire inner surface of 60 nm or less, and the dish shaped storage portion has a solution capacity of 3.8 mL or greater.

With the contact lens storage container with a constitution according to this mode, the inner surface of the dish shaped storage portion has a smooth form with no irregularities. Here, being smooth with no irregularities along its entirety and formed with a curvature radius that continuously changes means all points are connected with a common tangent line, and there are no inflection points that do not have a common tangent line. Specifically, with conventional contact lens containers, there were many items with irregular shapes given to the inner surface of the storage portion to make taking the lenses out easier, but the inventors of the present invention discovered that it is easy for a biofilm to form on these irregular shapes. In light of this, by eliminating the irregular shapes from the inner surface of the dish shaped storage portion, it was found that it is possible to effectively suppress the generation of biofilms.

However, when the irregular shape is eliminated from the storage portion inner surface, there is the risk that the lens will stick to the inner surface and be difficult to take out. In light of that, by setting the surface roughness of the storage portion inner surface to 60 nm or less, the inventors of the present invention found that it is possible to inhibit sticking of the lens. Furthermore, from the fact that the storage portion inner surface is formed to be sufficiently smooth, they also found that it is possible to inhibit entry of bacteria to the inner surface and the like, and that it is also possible to increase the suppression effect on the formation of biofilms. Also, based on this new knowledge, by making the inner surface of the dish shaped storage portion a smooth surface as with this mode, it is possible to effectively inhibit the generation of a biofilm while ensuring the ease of taking the lenses out.

In addition, with this mode, the solution capacity of the dish shaped storage portion is set at 3.8 mL or greater. By doing this, it was possible to suppress microbe contamination inside the container. Specifically, with a lens container according to the conventional constitution, to reduce the used volume of storage solution, there was a tendency to reduce as much as possible the solution capacity of the storage portion, but with this mode, rather, a large solution capacity was used. By doing this, it becomes possible to suppress the total volume of bacteria that enters the eye of the user adhered to the contact lens taken from the container due to the dilution effect of the solution. As a result, for example even when bacteria is generated, it is possible to reduce the risk of bacterial infection.

In this way, with this mode, by equipping a special constitution that is completely opposite to the conventional technical awareness, it became possible to effectively exhibit the suppression effect of biofilm formation and ease of taking out lenses. Then, with this mode, since it is not necessary to use a special member such as a member having an antimicrobial agent or photocatalytic function, it is possible to manufacture inexpensively, making it possible to obtain excellent cost efficiency.

A second mode of the present invention is the contact lens storage container of the first mode, wherein the soft contact lenses includes low water content nonionic soft contact lenses.

With low water content nonionic soft contact lenses, since the water content is low, it is possible to reduce the risk of bacteria floating in the storage solution from becoming trapped on the lens or the like, and since they are nonionic, dirt does not attach easily, and it is possible to reduce the risk of bacteria adhering to the lenses together with dirt. In light of this, by using low water content nonionic soft contact lenses in combination with a contact lens storage container like that of the present invention, it is possible to obtain a more excellent bacterial infection suppression effect. Here, as the low water content nonionic soft contact lenses, examples include soft contact lenses made from polymerizable hydrophilic monomers such as 2-hydroxyethylmethacrylate (HEMA), 2-hydroxyethyl acrylate (2-HEA), methacrylate glyceryl (GMA), 3-hydroxypropyl=methacrylate, 3-hydroxypropylacrylate, 4-hydroxybutyl=methacrylate, 4-hydroxybutyl=acrylate, N-vinyl pyrrolidone (NVP), acrylamide, methacrylamide, N, N-dimethyl acrylamide (DMA), N, N-dimethyl methacrylamide (DMMA) and the like, silicone monomers such as tris (trimethylsiloxy)-γ-methacryloxy propylsilane and the like, and furthermore, siloxane macromonomers having a polysiloxane structure for the side chain for which the number average molecular weight is approximately 1000 to 10000, and poly(organosiloxane) macromonomers having a polysiloxane structure for the main chain, or the like.

A third mode of the present invention is the contact lens storage container of the first or second mode, wherein the lid member has an inner surface that covers the opening portion of the dish shaped storage portion, the inner surface being a smooth surface with no irregularities.

With this mode, roughly the entire inner surface of the lens containing area defined by the dish shaped storage portion and the lid member are a form with no irregularities. By doing this, it is possible to further inhibit the formation of a biofilm. However, the inner surface that covers the opening portion of the dish shaped storage portion does not necessarily have to be formed with its entirety without irregularities, and for example it is also acceptable to have seal projections formed at the outer periphery portion of that inner surface. Also, as the inner surface, a flat surface can be preferably used, but a swelling or concave shape spherical surface or the like can also be used. Here, more preferably, with the lid member, for the inner surface that covers the opening portion of the dish shaped storage portion as well, the same as the inner surface of the dish shaped storage portion, this is a smooth surface with a surface roughness of 60 nm or less. By working in this way, it is possible to further suppress the formation of a biofilm on the inner surface of the lid member.

A fourth mode of the present invention is a contact lens storage container of any one of the first to third modes, wherein the lid member has a tightly sealed constitution in relation to the dish shaped storage portion.

Specifically, the lid member of the present invention does not necessarily have to be limited to a constitution that tightly seals the dish shaped storage portion, and for example in a case of an item used only in a state with the case main unit placed on a flat surface, can have the opening portion of the dish shaped storage portion only covered by the lid member. In light of that, with this mode, since the outflow of storage solution is prevented by tight sealing of the dish shaped storage portion with the lid member, it is possible to place the storage container in a bag or the like and carry it along or the like.

A fifth mode of the present invention is a contact lens storage container of any one of the first through fourth modes, wherein the curvature radius of the inner surface of the dish shaped storage portion is larger than a curvature radius of a convex surface of the soft contact lens stored in the dish shaped storage portion. By working in this way, it is possible to suppress deformation of the lens inside the storage area, and it is possible to reduce the risk of lens damage. Furthermore, since the contact area of the lens surface with the storage portion inner surface is smaller, it is possible to make it easier to take out the lens.

A sixth mode of the present invention is a contact lens storage container of any one of the first through fifth modes, wherein the inner surface of the dish shaped storage portion is the smooth surface with the surface roughness of 1 nm to 60 nm.

With this mode, it is possible to form a storage container that can effectively exhibit ease of taking out lenses and a biofilm formation inhibiting effect with excellent manufacturing efficiency. Specifically, by making the surface roughness of the dish shaped storage portion inner surface 60 nm or less, or more preferably 50 nm or less, it is possible to more effectively suppress sticking of the lens to the dish shaped storage portion inner surface, making it possible to make it easier to take the lenses out, and also, the inner surface irregular shapes are made smaller, and it is possible to increase the biofilm formation suppression effect. Meanwhile, by making the surface roughness of the dish shaped storage portion inner surface 1 nm or greater, or more preferably 5 nm or greater, it is possible to make a high level polishing process or the like unnecessary, making it possible to reduce the manufacturing cost.

A seventh mode of the present invention is a contact lens storage container of any one of the first through sixth modes, wherein the case main unit is formed using at least one or more resin material selected from a group consisting of polypropylene, polyethylene, polyethylene telephthalate, polycarbonate, polystyrene and copolymers thereof, or acrylonitrile butadiene styrene copolymer resin.

With this mode, by using a resin material with excellent formability, it is possible to form the case main unit with good cost efficiency. As the resin material for this mode, in specific terms, examples include product name "Novatec PP" made by Japan Polypropylene Corp., product name "SunAllomer" made by SunAllomer Ltd., product name "G757X" made by Japan PolyStyrene Inc., product name "A-PET" made by Echizen Polymer Co., Ltd., and product name "UMG ABS" made by UMG ABS, Ltd.

An eighth mode of the present invention is a contact lens storage container of any one of the first through seventh modes, wherein the inner surface of the dish shaped storage portion is fowled by using a metal mold with a smooth forming surface corresponding to the inner surface of the dish shaped storage portion so that the smooth forming surface is transferred to make the inner surface of the dish shaped storage portion smooth.

With this mode, since the smooth surface formed on the metal mold is transferred to the inner surface of the dish shaped storage portion, by using the metal mold repeatedly, simply by forming a smooth surface on the metal mold, it is possible to manufacture a plurality of case main units having a smooth surface for the inner surface of the dish shaped storage portion. By doing this, excellent manufacturing efficiency is obtained without bringing a substantial increase in the manhours for the manufacturing line of the case main unit, and it is possible to obtain excellent quality stability of the dish shaped storage portion inner surface.

KEYS TO SYMBOLS

10: storage container; 12: storage portion 14: case main unit; 16: cap; 19: opening portion; 24: inner surface

BEST MODE FOR CARRYING OUT THE INVENTION

A fuller understanding of the present invention will be provided through the following detailed description of the preferred embodiments of the invention with reference to the accompanying drawings.

Figure 1:
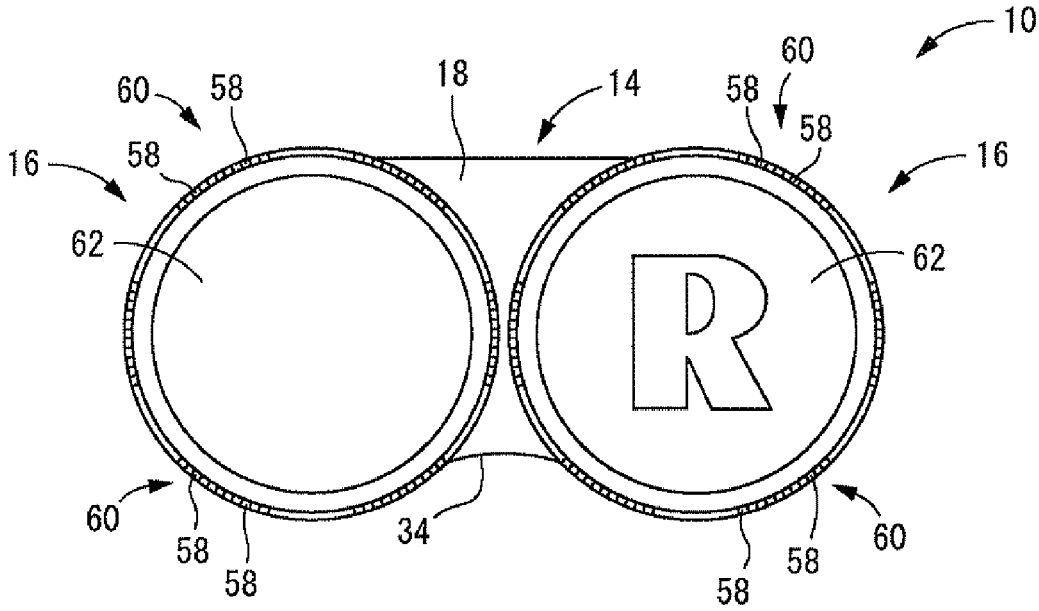
FIG. 1 is a top plan view of a contact lens storage container as an embodiment of the present invention.
Figure 2:
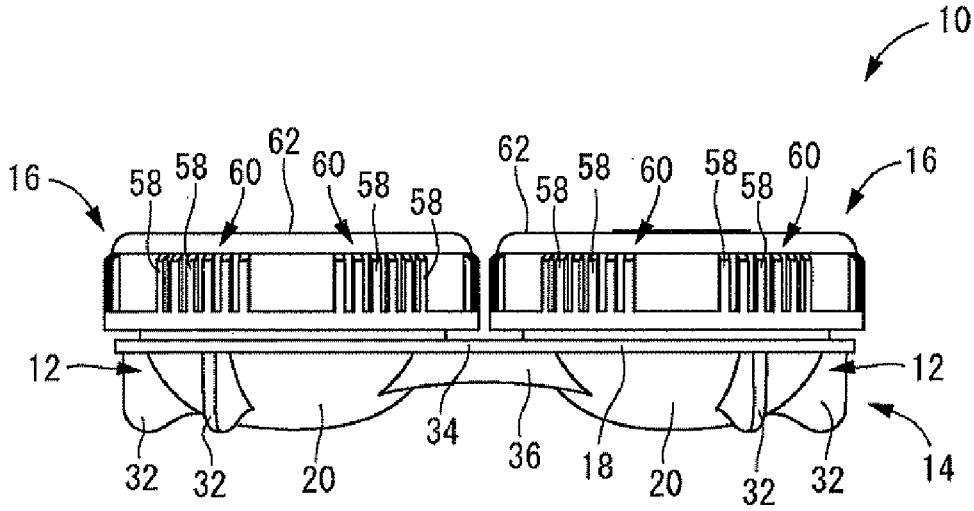
FIG. 2 is a side view of the same contact lens storage container.

First, FIG. 1 and FIG. 2 show a contact lens storage container 10 according to one embodiment of the present invention. The storage container 10 is constituted including a case main unit 14 formed as a single unit with storage portions 12, 12 as a pair of dish shaped storage portions that open upward, and caps 16, 16 as a pair of lid members covering the respective storage portions 12, 12. Note that with the explanation below, unless otherwise noted, the vertical direction means the vertical direction in FIG. 2.

Figure 3:
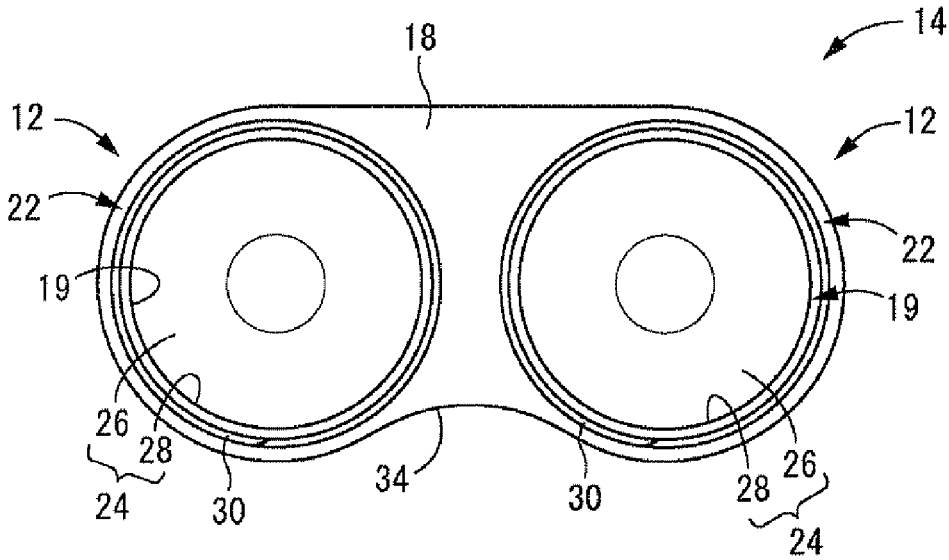
FIG. 3 is a top plan view of the case main unit that constitutes the same contact lens storage container.
Figure 4:
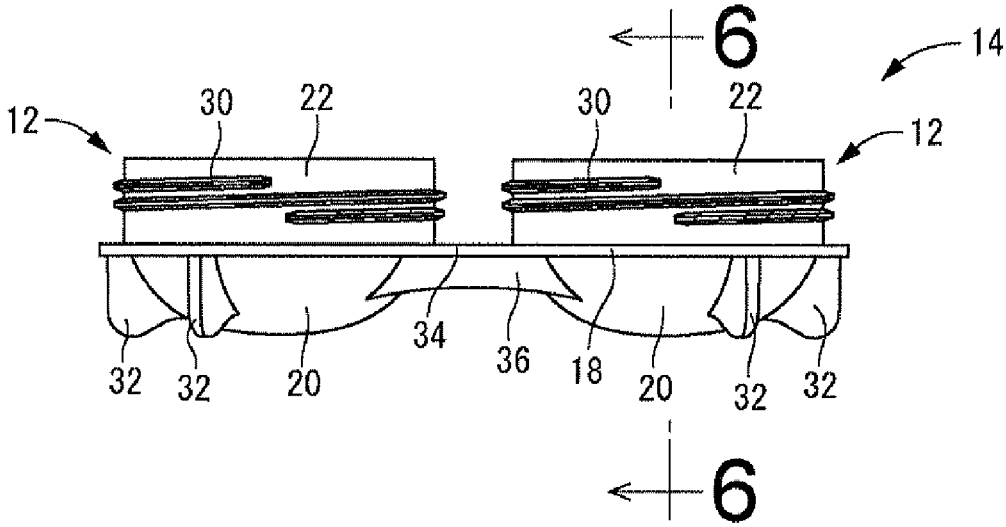
FIG. 4 is a side view of the same case main unit.
Figure 5:
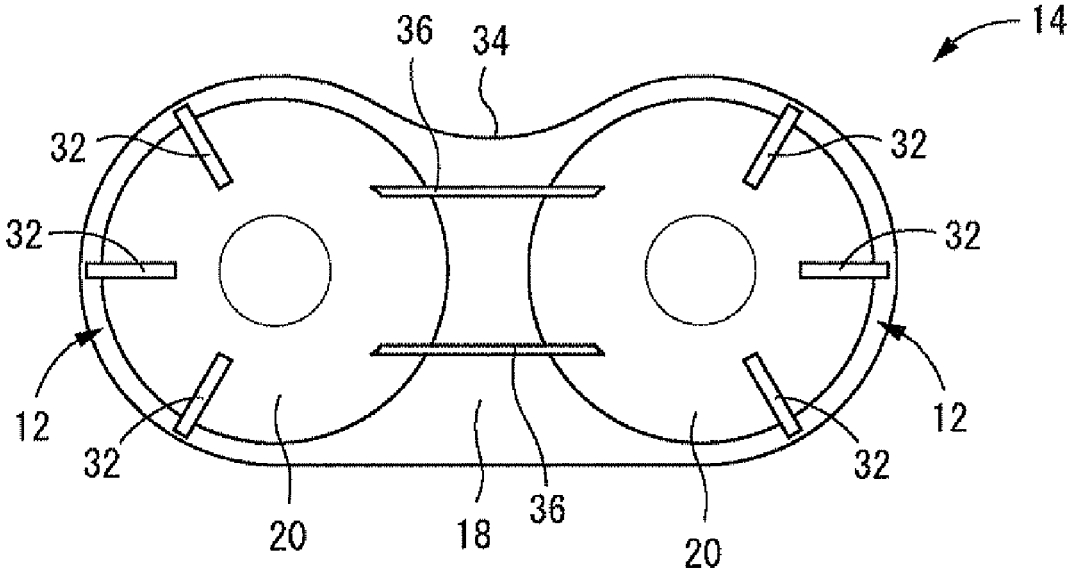
FIG. 5 is a bottom plan view of the same case main unit.

The case main unit 14 is shown in FIG. 3 to FIG. 5. The case main unit 14 is a single unit formed item with the pair of storage portions 12, 12 connected by a flat plate shaped connecting plate portion 18. This pair of storage portions 12, 12 are constituted in the same way as each other, so hereafter, we will describe one storage portion 12.

Figure 6:
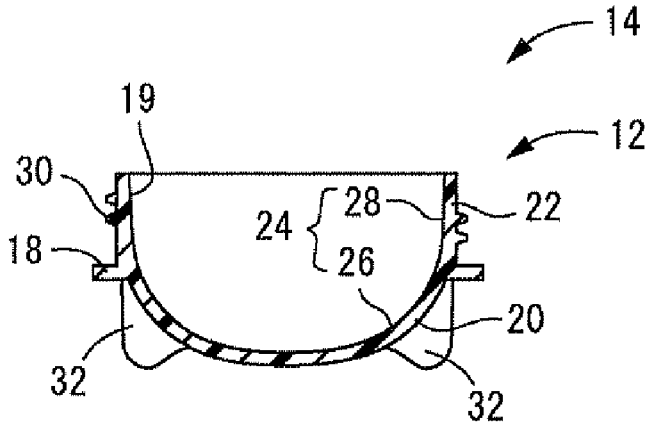
FIG. 6 is a cross section view taken along line 6-6 of FIG. 4.

As shown in FIG. 6, the storage portion 12 for which an opening portion 19 that opens upward is formed has a roughly round cylinder shape with a bottom, and is formed including a bottom portion 20 having a roughly spherical shell shape for which the upper portion is concave, and a tube portion 22 that has a roughly tube shape standing upward from the outer periphery portion of the bottom portion 20. Then, the upper edge portion of the tube portion 22 is used as the opening portion 19 of the storage portion 12, and the inner diameter dimensions of the opening portion 19 are also made to be larger than the lens diameter dimensions of the contact lenses to be stored.

Also, the inner surface 24 of the storage portion 12 is formed including a bottom surface 26 which is the inner surface of the bottom portion 20, and a tube shaped surface 28 which is the inner surface of the tube portion 22. The bottom surface 26 is a curved surface which is concave upward. Here, the curvature radius of the bottom surface 26 can be roughly constant, but specifically with this embodiment, the bottom surface 26 can change continuously so that the curvature radius becomes larger going toward the center portion, and the curvature radius becomes larger than the curvature radius of the front surface of the lens of the contact lenses to be stored across the entirety of the bottom surface 26. By doing this, the bottom surface 26 has a curved surface approaching a flat surface as it goes toward the center portion.

Meanwhile, the tube shaped surface 28 is formed rising upward continuing smoothly from the outer periphery portion of the bottom surface 26, and specifically with this embodiment, it has a gently tapered surface that has a slightly broadened diameter as it goes upward.

Here, the bottom surface 26 and the tube shaped surface 28 are both connected with a common tangent line at all the points, and the form is such that there are no inflection points that do not have a common tangent line. Then, the bottom surface 26 and the tube shaped surface 28 are connected smoothly using the common tangent line. By doing this, the inner surface 24 of the storage portion 12 is formed smoothly with no irregularities across its entirety and having a curvature radius that continuously changes.

Furthermore, the inner surface 24 is a sufficiently smooth surface to the level of having a sheen across its entirety, and specifically, it is a smooth surface with a surface line roughness of Ra 60 nm or less, more preferably 1 nm or greater and 60 nm or less, and even more preferably, 5 nm or greater and 50 nm or less. Specifically, by making the surface line roughness Ra of the inner surface 24 1 nm or greater, it is possible to make a high level polishing process or the like unnecessary, making it possible to reduce manufacturing costs. Together with that, by making the surface line roughness Ra of the inner surface 24 60 nm or less, the entering of bacteria to the inner surface 24 or the like is inhibited, more effectively suppressing the formation of a biofilm, and also, by making a smoother surface, it is possible to further improve the ease of taking out the lenses.

Contact lens storage solution is made to be accumulated in the storage portion 12 having an inner surface 24 constituted in this way. In light of that, the solution capacity of the storage portion 12 is preferably set to be 3.8 mL or greater so that when at least 3 mL of storage solution is stored it is about 70 to 80% full. Note that the upper limit of the solution capacity of the storage portion 12 is not particularly restricted, but it is preferable to have it be of a level for which the used storage solution is not excessive, and for example setting to 6 mL or less is preferable.

Also, a screw 30 is formed as a single unit at the circumferential surface of the tube portion 22. Furthermore, a suitable number of downwardly projecting board shaped leg portions 32 are formed as a single unit at the outer surface of the bottom portion 20. With this embodiment, at the bottom portion 20, three leg portions 32 are formed with a roughly equal interval open in the peripheral direction of the bottom portion 20 at a site positioned on the outside of the case main unit 14. These leg portions 32 are made to project further downward than the bottom edge portion of the bottom portion 20, and the height position of the projection tip edge parts of the plurality of leg portions 32 are made to be equal to each other. Note that the leg portions 32 specifically with this embodiment are formed with the projection tip parts having a curve, and the base tip portion of the upper edge is formed straddling the outer surface of the bottom portion 20 and the bottom surface of the connecting plate portion 18, but of course the specific shape of the leg portions 32 is not limited in any way.

A pair of storage portions 12 with this kind of constitution are mutually connected by connecting plate portion 18. The connecting plate portion 18 has a board shape having specified thickness dimensions, and the tube portion 22 at the circumferential surface of the storage portion 12 is formed as a single unit with the storage portion 12 so as to broaden in the direction perpendicular to the axis of the storage portion 12 from the connecting portion of the bottom portion 20. By doing this, the pair of storage portions 12 are connected to each other by connecting plate portion 18 equally in the opening direction. Note that the specific shape of the connecting plate portion 18 is not limited in any way, but specifically with this embodiment, while there is the end edge portion straddling between the pair of storage portions 12, a concave portion 34 sunken in the inward direction is formed, and with the concave portion 34, distinguishing between the right eye storage portion 12 and the left eye storage portion 12 is made easier. Also, the pair of storage portions 12 are mutually connected by the pair of crossbeam portions 36. The crossbeam portions 36 are formed projecting downward from the connecting plate portion 18, and are formed mutually straddling between the circumferential surfaces of the bottom portion 20. With these crossbeam portions 36, the strength between the pair of storage portions 12 for the case main unit 14 is increased.

A case main unit 14 with this kind of constitution is preferably formed using at least one or more resin material selected from the group consisting of polypropylene (PP), polyethylene (PE), polyethylene telephthalate (PET), polycarbonate (PC), polystyrene (PS), and copolymers thereof, and acrylonitrile butadiene styrene copolymer resin (ABS). In specific terms, examples include product name "Novatec PP" made by Japan Polypropylene Corp., product name "SunAllomer" made by SunAllomer Ltd., product name "G757X" made by Japan PolyStyrene Inc., product name "A-PET" made by Echizen Polymer Co., Ltd., and product name "UMG ABS" made by UMG ABS, Ltd.

Figure 7:
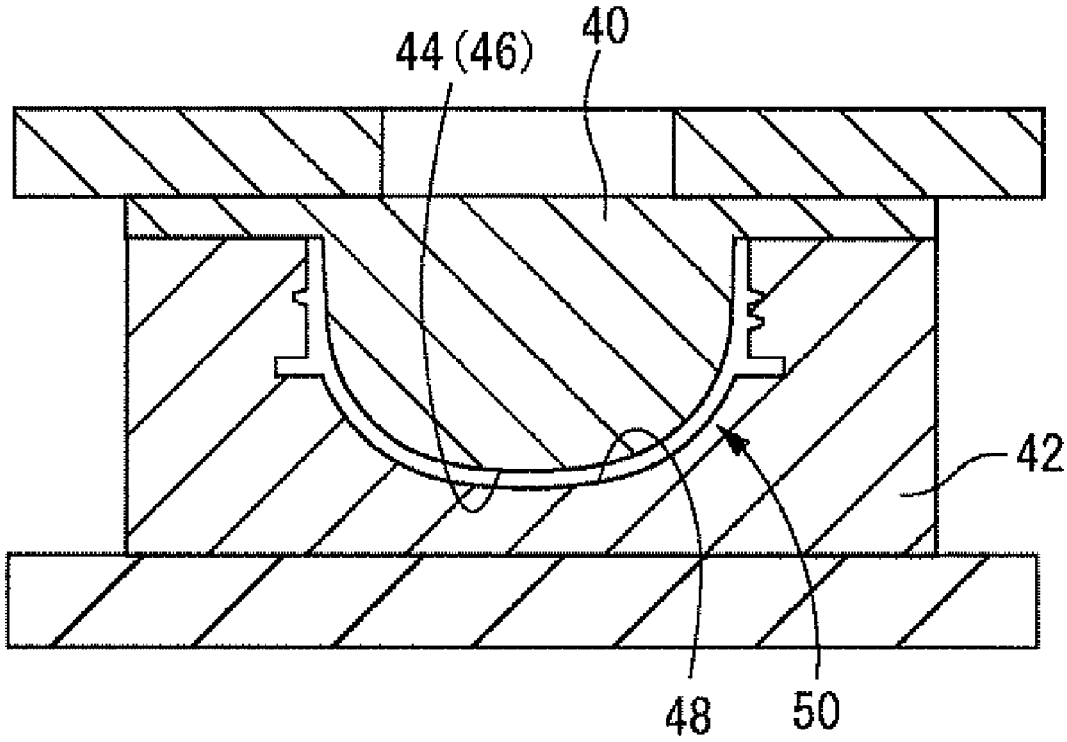
FIG. 7 is a cross section explanatory drawing with a model view of the metal mold for forming the case main unit shown in FIG. 3.
Figure 8:
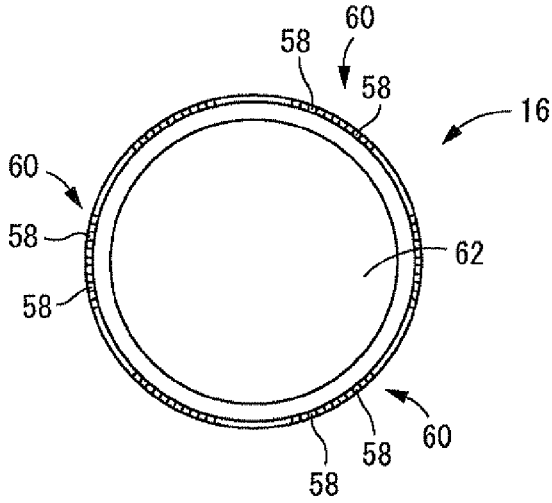
FIG. 8 is a top plan view of the lid member that constitutes the same contact lens storage container.
Figure 9:
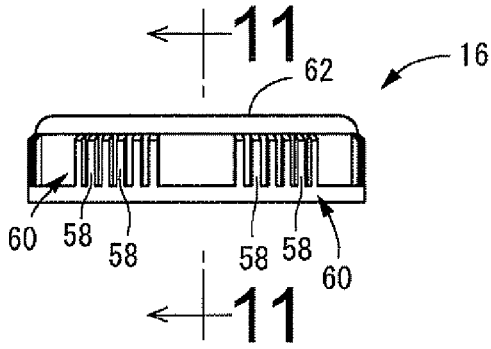
FIG. 9 is a side view of the same lid member.
Figure 10:
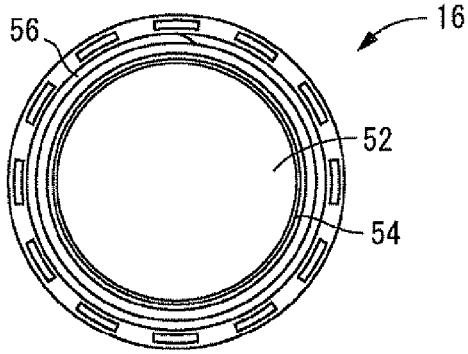
FIG. 10 is a bottom plan view of the same lid member.
Figure 11:
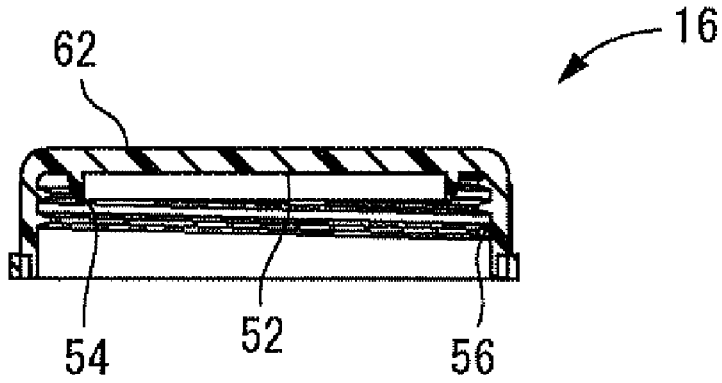
FIG. 11 is a cross section view taken along line 10-10 of FIG. 8.

In light of this, the case main unit 14 can be suitably manufactured using a conventionally known resin forming method or the like, and for example the injection molding method described hereafter can be used advantageously. As shown as a model in FIG. 7, first, a male mold 40 and female mold 42 are prepared as metal molds. Note that as shown as a model in FIG. 7, both of these molds 40, 42 are constituted suitably divided. Also, as both of these molds 40, 42, for example pre-hardened steel or the like can be suitably used, but any other metal material can also be used.

On the male mold 40, a convex shaped male side forming surface 44 is formed. There, the male side forming surface 44 is formed including an inner surface forming surface 46 having a shape corresponding to the inner surface 24 of the case main unit 14. By having a suitable polishing process or the like implemented, the inner surface forming surface 46 is formed which is smooth with no irregularities with a curvature radius that continuously changes across its entirety, with a smooth surface of a surface line roughness Ra of 60 nm or less, more preferably 1 nm or greater and 60 nm or less, and even more preferably 5 nm or greater and 50 nm or less.

Meanwhile, on the female mold 42, a concave shaped female side forming surface 48 is formed. The female side forming surface 48 is formed including a form corresponding to the outer surface of the bottom portion 20 for the case main unit 14, or the screw 30, the leg portions 32, or the crossbeam portions 36 or the like.

Then, using a mold tightening device (not illustrated), the male mold 40 and female mold 42 have the mold closed in the axis direction (in FIG. 7, the vertical direction), and a forming cavity 50 is formed between the mold matching surfaces of both molds 40, 42. In relation to this forming cavity 50, for example an injection device or the like (not illustrated) is used to do injection filling inside the forming cavity 50 through a spool or runner (not illustrated) with a thermoplastic resin material. As this thermoplastic resin material, it is possible to use a resin material suitably used as a material for the case main unit 14 as described above. Then, after the thermoplastic resin material injection filled inside the forming cavity 50 is hardened by cooling, by taking out the formed item by opening the mold for both molds 40, 42, it is possible to obtain the case main unit 14.

By working in this way, it is possible to form the inner surface 24 into a smooth surface by transferring the inner surface forming surface 46 of the male mold 40 which has a smooth surface to the inner surface 24 of the case main unit 14. Therefore, by repeatedly using both molds 40, 42, a special polishing process or the like is not required, and it is possible to manufacture a large number of case main units 14 having a smooth surface inner surface 24 with excellent cost efficiency and quality stability. However, when necessary, it is of course possible to implement a polishing process or the like on the inner surface 24 of the case main unit 14 after injection molding, or to have the surface roughness of the inner surface 24 be made smaller or the like.

Meanwhile, a pair of caps 16, 16 have roughly the same structure as each other, and hereafter, we will describe cap 16 for the left eye. The cap 16 is shown in FIG. 8 through FIG. 11. The cap 16 has a roughly tube shape with a bottom that opens downward with an inner diameter dimension slightly larger than the outer diameter dimension of the tube portion 22 at the case main unit 14. Also, the cap 16 is preferably formed from the same resin material as the case main unit 14 like that described previously. Here, the combination of materials of the case main unit 14 and the cap 16 is a combination of a relatively soft resin material such as PP or PE or the like, and a relatively hard resin material such as PS, PC, PET, and ABS or the like, and preferably, it is desirable to have a combination for which both the case main unit 14 and the cap 16 are formed from a relatively soft resin material. Note that specifically with this embodiment, the cap 16 is a transparent member formed from a propylene ethylene copolymer, and it is possible to visually confirm the interior of the storage portion 12 from the outside through the cap 16 with the storage portion 12 in a covered state.

Furthermore, on the upper base 52 of the cap 16, a seal projection wall 54 is formed as a single unit projecting toward the opening direction of the cap 16. The seal projection wall 54 is a roughly tube shape formed on the concentric axis of the upper base 52 at the circumferential portion of the upper base 52, and that circumferential surface has a tapered shape that gradually becomes smaller in the diameter dimensions as it goes toward the projection tip portion. Then, specifically with this embodiment, the unformed portion of the seal projection wall 54 with the upper base 52 is a flat surface, and the upper base 52 is the same smooth surface as the inner surface 24 of the case main unit 14.

Also, on the inner peripheral surface of the cap 16, a screw 56 that engages with the screw 30 of the storage portion 12 is formed as a single unit projecting in the inward direction. Furthermore, at the circumferential surface of the cap 16, a plurality of antislip portions 60 consisting of a plurality of projections 58 extending in the vertical direction are formed separated by a specified interval in the circumferential direction.

Note that specifically with this embodiment, on the top surface 62 of one cap 16, in the storage portion 12 covered by that cap 16, the letter "R" is formed projecting so as to float upward to indicate that the contact lens for the right eye is stored in that, and the top surface 62 of the other cap 16 is a flat surface. Furthermore, with this embodiment, while the cap 16 for which the letter "R" is formed on the top surface 62 is transparent blue, the other cap 16 is transparent and colorless.

Also, for the cap 16 as well, it is possible to have a constitution suitably using a conventionally known resin forming method or the like, and preferably, it is possible to more advantageously manufacture this using the same injection molding method as with the case main unit 14.

Figure 12:
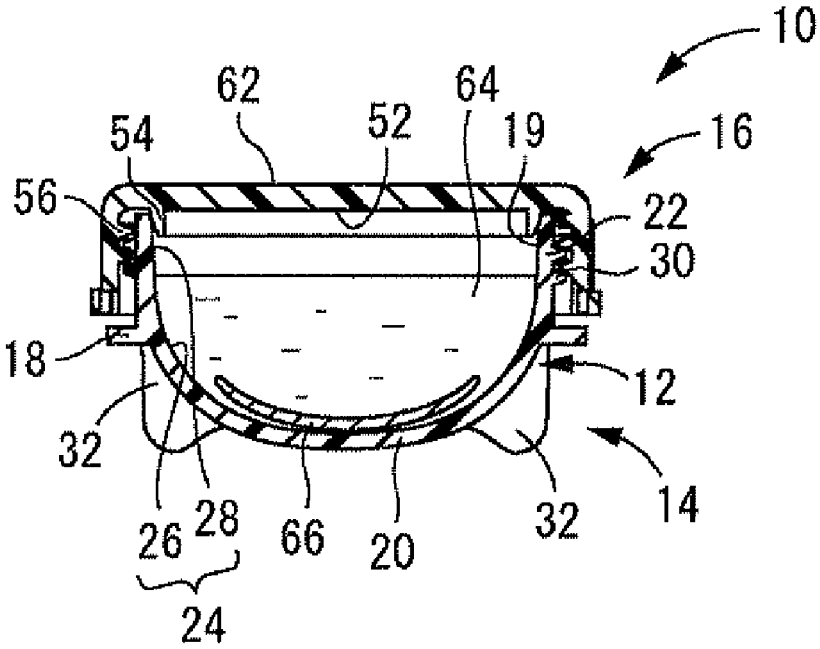
FIG. 12 is a cross section explanatory diagram for explaining the storage state of the contact lens.

The cap 16 with this kind of constitution, by covering from above on the storage portion 12 at the case main unit 14 and being screwed in, is screwed onto the tube portion 22 by the screw 30 of the storage portion 12 and the screw 56 of the cap 16. In light of this, the upper base 52 of the cap 16 is made to be in close contact with the opening portion 19 of the storage portion 12, and by having the seal projection wall 54 enter inside the opening portion 19, the opening portion 19 is sealed. By doing this, as is shown as a model in FIG. 12, the opening portion 19 of the storage portion 12 is in a tightly sealed state covered by the upper base 52 of the cap 16.

With the storage container 10 constituted in this way, when storing lenses, the storage solution 64 is accumulated in the storage portion 12, and after immersing the contact lens 66 in the storage solution 64, by covering the opening portion 19 of the storage portion 12 using the cap 16, the contact lens 66 is stored in an immersed state in the storage solution 64 within the storage portion 12. Then, when using the lens, the cap 16 is removed from the case main unit 14, the lens 66 is taken out from inside the storage portion 12 and the storage solution 64 is discarded, and this is repeatedly used multiple times.

Here, as the contact lens 66 stored in the storage container 10, there is no particular restriction as long as it is a soft contact lens, but this can be used preferably in combination with a low water content nonionic soft contact lens belonging to Group I of the FDA (Food and Drug Administration) categories. As a low water content nonionic soft contact lens, examples include items made from polymerizable hydrophilic monomers such as 2-hydroxyethylmethacrylate (HEMA), 2-hydroxyethyl acrylate (2-HEA), methacrylate glyceryl (GMA), 3-hydroxypropyl=methacrylate, 3-hydroxypropylacrylate, 4-hydroxybutyl=methacrylate, 4-hydroxybutyl=acrylate, N-vinyl pyrrolidone (NVP), acrylamide, methacrylamide, N, N-dimethyl acrylamide (DMA), N, N-dimethyl methacrylamide (DMMA) and the like, silicone monomers such as tris (trimethylsiloxy)-γ-methacryloxy propylsilane and the like, and furthermore, siloxane macromonomers having a polysiloxane structure for the side chain for which the number average molecular weight is approximately 1000 to 10000, and poly(organosiloxane) macromonomers having a polysiloxane structure for the main chain, or the like.

In light of that, with the storage container 10 of this embodiment, because the inner surface 24 of the storage portion 12 is a smooth surface with no irregularities, it is possible to inhibit the formation of a biofilm. In particular with this embodiment, because the upper base 52 of the cap 16 that covers the opening portion 19 of the storage portion 12 is also a flat, smooth surface, formation of a biofilm is also suppressed on the upper base 52. Furthermore, because the solution capacity of the storage portion 12 is ensured to be large at 3.8 mL or greater, a dilution effect for microorganism volume due to the storage solution can be expected, and it is possible to further reduce the risk of microorganism contamination on the lens. In particular, when using a combination of the storage container 10 and a low water content nonionic soft contact lens, it is possible to further reduce the risk of the lens trapping microorganisms floating in the storage solution or microorganisms adhering to dirt by absorbing water or adhesion of dirt.

Then, simply with just eliminating the irregularities from the inner surface 24 of the storage portion 12, the contact area of the inner surface 24 and the lens becomes larger, and there is the risk that it will not be easy to take out the lens. However, with this embodiment, by making the inner surface 24 a sufficiently smooth surface at a surface roughness of 60 nm or less, it is possible to suppress the sticking of the lens to the inner surface 24. By doing this, it is possible to easily slide and lead the lens along the inner surface 24 to the opening portion 19, making it easy to take out the lens.

In addition, with this embodiment, this suppression effect on biofilm formation and the increase in ease of taking out lenses are realized by a specialized shape of the storage container, and it is possible to provide at very low cost a contact lens storage container that can combine a high level of these excellent effects.

Above, we gave a detailed description of an embodiment of the present invention, but this is ultimately only an example, and the present invention is not to be interpreted as being limited in any way by the specific notations of this embodiment.

For example, with the aforementioned embodiment, the bottom surface 26 of the storage portion 12 can be a flat plane at the center portion, or the like. In such a case, the flat plane of the center portion and the curved surface at its outside are connected so that there are no inflection points that do not have common tangent lines. Also, because the leg portions 32 are not absolutely necessary, for example instead of forming the leg portions 32, it is also possible to have the bottom edge portion of the bottom portion 20 be formed flat to make the case main unit 14 able to support itself.

Also, the lid member does not absolutely have to be a tightly sealed constitution in relation to the storage portion. For example, instead of the cap 16 for the aforementioned embodiment, it is also possible to have a simple board shaped lid member cover the opening portion 19 by being placed in a non-fixed manner on the opening edge surface of the opening portion 19 for the storage portion 12.

Furthermore, with the aforementioned embodiment, the antislip portion 60 formed on the circumferential surface of the cap 16 and the letter "R" formed on the top surface 62 and the like are nothing more than examples, and do not absolutely have to be there, and their specific shapes can be set freely. For example, it is of course also possible to form an antislip portion 60 across the entire circumference of the cap 16, and on the top surface 62, for a mark or letter indicating the manufacturer, or any letter or symbol, it is possible to form a projecting form the same as that of the aforementioned embodiment, or to do this using paint or the like.

EMBODIMENTS

Tests performed to confirm the technical effects of the contact lens manufacturing method according to the present invention are noted hereafter as embodiments. However, it goes without saying that the present invention is in no way limited by the notation of these embodiments.

(Test Relating to Dish Shaped Storage Portion Solution Capacity)

First, as test specimen 1, two test specimens were prepared, a low water content nonionic soft contact lens (product name: Menicon Premie) made by Menicon Co., Ltd. belonging to FDA category Group I, and a high water content ionic lens (product name: Acuvue2) made by Menicon Co., Ltd. belonging to Group IV. Then, to attach artificial dirt, the test specimens were dipped in bovine serum, and after removing the test specimens from the serum and wiping off the excess serum, using that as microorganism dirt, inoculation was done so as to have the following bacteria or fungi at approximately $10^6$ cfu/Lens.

Bacteria: *Staphylococcus epidermidis* ATCC35983 having a biofilm forming ability Fungi: *Candida albicans* IFO1594

Next, 2 mL, 3 mL, and 4 mL plastic tubes were dispensed with contact lens disinfectant (product name: Epica Cold) made by Menicon Co., Ltd., and the test specimens inoculated with the aforementioned germs were immersed in this, and the germ reduction volume (Log reduction value) after 4 hours was calculated based on the following formula.

Log reduction=Log(inoculated germ count/residual viable germ count)

TABLE 1

| | | 2 ml | 3 ml | 4 ml |
|---|---|---|---|---|
| *Staphylococcus epidermidis* | Test specimen 1 | X | ○ | ○ |
| ATCC35983 (bacteria) | Test specimen 2 | X | Δ | ○ |
| *Candida albicans* | Test specimen 1 | ○ | ○ | ○ |
| IFO1594 (fungi) | Test specimen 2 | X | ○ | ○ |

TABLE 2

| | Log Reduction value | Evaluation |
|---|---|---|
| Bacteria | Less than 2.4 log | X |
| | 2.4 log or greater, less than 3.6 log | Δ |
| | 3.6 log or greater | ○ |
| Fungi | Less than 0.8 log | X |
| | 0.8 log or greater, less than 1.2 log | Δ |
| | 1.2 log or greater | ○ |

Table 1 shows the results of the test noted above. Note that with the ISO14729 Standalone test first reference, it is set that contact lens care supplies are to be reduced to bacteria 3 log or greater and fungi 1 log or greater within a specified disinfecting time (e.g. 4 hours), so as shown in table 2, regarding bacteria, less than 2.4 log is shown as "X," 2.4 log or greater and less than 3.6 log is shown as "ΔA," and 3.6 log or greater is shown as "○," and regarding fungi, less than 0.8 log is shown as "X," 0.8 log or greater and less than 1.2 log is shown as "Δ," and 1.2 log or greater is shown as "○" in table 1.

From the results of table 1 noted above, if there is a solution volume of at least 3 mL, it was confirmed that generally good results were obtained for both test specimen 1 and test specimen 2. Normally, a contact lens storage container is used with solution placed in the storage portion filled to about 70 to 80%, allowing the entire lens to be immersed, and to a level so that the solution does not overflow. Therefore, when at least 3 mL of solution volume is 70 to 80%, as with the present invention, by ensuring a solution capacity of 3.8 mL or greater, it is clear that a good disinfecting effect can be obtained.

(Test Regarding the Case Inner Surface Shape and Surface Roughness)

The results shown hereafter of preparing storage containers for embodiments 1 to 3 having a constitution according to the present invention and storage containers for comparative examples 1 to 6 according to a conventional constitution, and test results for the biofilm forming volume and ease of taking out the lens are shown in table 3 shown below. Note that the surface roughness in the description of the embodiments and comparative examples below is the surface line roughness [Ra].

Embodiment 1

The surface roughness of the storage portion inner surface is 5.5 nm. The inner surface has no irregularities. The opening portion inner diameter is 23 mm. The solution capacity is 4.9 mL. (Main unit: PP, Lid member: Propylene ethylene copolymer)

Embodiment 2

The surface roughness of the storage portion inner surface is 29.3 nm. The inner surface has no irregularities. The opening portion inner diameter is 23 mm. The solution capacity is 4.9 mL. (Main unit: PP, Lid member: Propylene ethylene copolymer)

Embodiment 3

The surface roughness of the storage portion inner surface is 55.7 nm. The inner surface has no irregularities. The opening portion inner diameter is 23 mm. The solution capacity is 4.9 mL. (Main unit: PET, Lid member: PET)

Comparative Example 1

The surface roughness of the storage portion inner surface is 72.4 nm. The inner surface has no irregularities. The opening portion inner diameter is 23 mm. The solution capacity is 4.9 mL. (Main unit: PP, Lid member: PP)

Comparative Example 2

The surface roughness of the storage portion inner surface is 233 nm. The inner surface has no irregularities. The opening portion inner diameter is 23 mm. The solution capacity is 4.9 mL. (Main unit: PP, Lid member: PP)

Comparative Example 3

The surface roughness of the storage portion inner surface is 10 nm. The inner surface is formed from 12 flat planes, and there is a height difference of approximately 0.06 to 0.2 mm at the joining portion between surfaces. The opening portion inner diameter is 26 mm. The solution capacity is 6.4 mL. (Main unit: PP, Lid member: PP)

Comparative Example 4

The surface roughness of the storage portion inner surface is 17.7 nm. There are four projection shaped structures in a cross shape (length approx. 10 mm, height 0.1 to 0.4 mm, width 0.3 to 1.2 mm) at the inner surface bottom portion center. The opening portion inner diameter is 24 mm. The solution capacity is 4.8 mL. (Main unit: PP, Lid member: ABS resin)

Comparative Example 5

The surface roughness of the storage portion inner surface is 63.1 nm. The inner surface is formed from 12 flat planes, and there is a height difference of approximately 0.06 to 0.2 mm at the joining portion between surfaces. The opening portion inner diameter is 23 mm. The solution capacity is 4.8 mL (Main unit: ABS resin, Lid member: ABS resin)

Comparative Example 6

The surface roughness of the storage portion inner surface is 72.4 nm. There are 12 projections (height 0.2 to 0.3 mm, width 1.2 mm) extending radially toward the opening portion from the bottom portion center of the inner surface. The opening portion inner diameter is 23 mm. The solution capacity is 5.4 mL. (Main unit: PP, Lid member: PP)

TABLE 3

| | | | | Line roughness 60 nm or greater | | There are irregularities | | | |
|---|---|---|---|---|---|---|---|---|---|
| | Embod. 1 | Embod. 2 | Embod. 3 | Comp. ex. 1 | Comp. ex. 2 | Comp. ex. 3 | Comp. ex. 4 | Comp. ex. 5 | Comp. ex. 6 |
| Inner surface line roughness [Ra] nm | 5.5 | 29.3 | 55.7 | 72.4 | 233 | 10 | 17.7 | 63.1 | 72.4 |
| Are there irregularities? Yes/No | No | No | No | No | No | Yes | Yes | Yes | Yes |
| Biofilm | ○ | ○ | ○ | ○ | Δ | Δ | Δ | X | X |

TABLE 3-continued

| | | | | Line roughness 60 nm or greater | | There are irregularities | | | |
|---|---|---|---|---|---|---|---|---|---|
| | Embod. 1 | Embod. 2 | Embod. 3 | Comp. ex. 1 | Comp. ex. 2 | Comp. ex. 3 | Comp. ex. 4 | Comp. ex. 5 | Comp. ex. 6 |
| forming volume A | | | | | | | | | |
| Biofilm forming volume B | ○ | ○ | ○ | ○ | ○ | X | X | X | X |
| Ease of taking out lenses | ○ | ○ | ○ | X | X | ○ | ○ | ○ | ○ |

(Biofilm Forming Volume A)

For each test specimen of the aforementioned embodiments 1 to 3 and comparative examples 1 to 6, these were filled with 2 mL of culture fluid (0.25% glucose added soybean casein digest medium diluted by 20 times), and Staphylococcus epidermidis ATCC35983 having a biofilm forming ability was inoculated to approximately $10^5$ cfu/mL. Then, after culturing for 24 hours at 37° C., the culture fluid was removed, the formed biofilm was recovered using sterile water, and the viable germ count per 1 mL of fluid was measured.

TABLE 4

| | Viable germ count (cfu/ml) | Evaluation |
|---|---|---|
| Embodiment 1 | $7 \times 10^4$ | ○ |
| Embodiment 2 | $8 \times 10^4$ | ○ |
| Embodiment 3 | $8 \times 10^4$ | ○ |
| Comparative example 1 | $6 \times 10^4$ | ○ |
| Comparative example 2 | $5 \times 10^5$ | Δ |
| Comparative example 3 | $2 \times 10^5$ | Δ |
| Comparative example 4 | $3 \times 10^5$ | Δ |
| Comparative example 5 | $2 \times 10^6$ | X |
| Comparative example 6 | $3 \times 10^6$ | X |

TABLE 5

| Viable germ count (cfu/ml) | Evaluation |
|---|---|
| $10^6$ or greater | X |
| $10^5$ to $10^6$ | Δ |
| $10^5$ or less | ○ |

Table 4 shows the measurement values by the tests noted above. Note that as the evaluations in table 4, because germ volume of approximately $10^6$ cfu/mL is typically considered to be related to the manifestation of pathogenicity as set with $10^6$ cfu/mL germ volume with tests performed with the ISO14729 Stand-alone test, with this test, as shown in table 5, $10^6$ cfu/mL or greater was evaluated as "X," $10^5$ to $10^6$ cfu/mL as "Δ," and $10^5$ cfu/mL or less as "○."

As is clear from table 3 and table 4, with embodiments 1 to 3, it was confirmed that this exhibited an effective suppression effect on the formation of biofilm. Note that if we focus only on the biofilm forming volume, a good suppression effect is also obtained with comparative example 1. Therefore, if the inner surface of the storage portion does not have irregularities, if the surface roughness of the inner surface is of a degree that slightly exceeds a specified range as with the present invention, this is thought to be able to exhibit an effective suppression effect in about the same way for biofilm formation, and the existence of irregularities in the inner surface is thought to be a major factor in the formation of biofilm.

(Biofilm Forming Volume B)

After attaching artificial dirt by immersing a soft contact lens (product name: Acuvue2 made by Menicon Co., Ltd.) in bovine serum for 1 hour, inoculation was done so as to have approximately $10^5$ cfu/Lens of Staphylococcus epidermidis ATCC35983 which has biofilm forming ability. This lens was kept for one night in each lens case of embodiments 1 to 3 and comparative examples 1 to 6 with 3 mL of storage solution inserted (product name: Epica Cold made by Menicon Co., Ltd.). After repeating the above operation three times, safranin staining was used to confirm whether or not a biofilm had formed inside the lens case. Note that in table 3, when biofilm formation was found, this was indicated as "X," and when biofilm formation was not found, this was indicated as "O".

As is clear from table 3, regardless of the surface roughness of the storage portion inner surface, while biofilm formation was not found with embodiments 1 to 3 and comparative examples 1 and 2 which do not have irregular shapes on the inner surface, with comparative examples 3 to 6 which do have irregular shapes on the inner surface, biofilm formation was found. From this fact as well, the existence of irregular shapes on the inner surface is significantly related to biofilm formation, and with the present invention for which the inner surface has a smooth shape without irregularities, it was confirmed that there is an effective suppression effect on biofilm formation.

(Ease of Taking Out Lenses)

A low water content nonionic lens belonging to Group I of the FDA categories (product name: Menicon Soft MA made by Menicon Co., Ltd.), a high water content nonionic lens belonging to Group II (product name: Month Wear made by Menicon Co., Ltd.), and a high water content ionic lens belonging to Group IV (product name: Menicon Focus, made by Menicon Co., Ltd.) were prepared and lenses were placed in each lens case of the embodiments and comparative examples. Then, after completely immersing the lenses with normal saline solution placed to the 80% level in the lens cases, an evaluation was done of whether it was possible to smoothly take out the lens from the lens case. Note that in table 3, when none of the lenses stuck to the inner surface of the storage portion and taking out was smooth, this was indicated as "O," and when portion or all of the lenses stuck to the inner surface of the storage portion, this was indicated as "X."

From the results of this test, when there were irregularities in the inner surface of the storage portion, though taking out was easy regardless of the surface roughness of the inner surface, when there were no irregularities in the inner surface, when the surface roughness of the inner surface was greater than 60 nm, it was clear that there was a loss of ease in taking out the lens.

From the tests above, by not having irregularities in the inner surface of the storage portion, while it is possible to inhibit biofilm formation, by having the surface roughness of the inner surface be 60 nm or less, we confirmed that the ease of taking out lenses was increased. Then, with the present invention which does not have irregularities in the inner surface of the storage portion and has the surface roughness of the inner surface set to 60 nm or less, it was confirmed that it is possible to combine both a suppression effect on biofilm formation and a high level of ease of taking out lenses.

The invention claimed is:

1. A contact lens storage container adapted to be used frequently for storing soft contact lenses in a state immersed in storage solution, comprises:

a case main unit provided with a dish shaped storage portion that opens upward; and a lid member for covering an opening portion of the dish shaped storage portion, wherein an inner surface of the dish shaped storage portion is smooth with no irregularities along its entirety and is formed with a curvature radius that continuously changes, the dish shaped storage portion is a smooth surface with a surface roughness along the entire inner surface of 60 nm or less, and the dish shaped storage portion has a solution capacity of 3.8 mL or greater.

2. The contact lens storage container according to claim 1, wherein the soft contact lenses includes low water content nonionic soft contact lenses.

3. The contact lens storage container according to claim 1, wherein the lid member has an inner surface that covers the opening portion of the dish shaped storage portion, the inner surface being a smooth surface with no irregularities.

4. The contact lens storage container according to claim 1, wherein the lid member has a tightly sealed constitution in relation to the dish shaped storage portion.

5. The contact lens storage container according to claim 1, wherein the curvature radius of the inner surface of the dish shaped storage portion is larger than a curvature radius of a convex surface of the soft contact lens stored in the dish shaped storage portion.

6. The contact lens storage container according to claim 1, the inner surface of the dish shaped storage portion is the smooth surface with the surface roughness of 1 nm to 60 nm.

7. The contact lens storage container according to claim 1, the case main unit is formed using at least one or more resin material selected from a group consisting of polypropylene, polyethylene, polyethylene telephthalate, polycarbonate, polystyrene and copolymers thereof, or acrylonitrile butadiene styrene copolymer resin.

8. The contact lens storage container according to claim 1, wherein the inner surface of the dish shaped storage portion is formed by using a metal mold with a smooth forming surface corresponding to the inner surface of the dish shaped storage portion so that the smooth forming surface is transferred to make the inner surface of the dish shaped storage portion smooth.

* * * * *